US010240370B2

(12) United States Patent
Puscas et al.

(10) Patent No.: US 10,240,370 B2
(45) Date of Patent: Mar. 26, 2019

(54) VEHICLE DOOR LATCH WITH RELEASE LINKAGE BYPASS DEVICE

(71) Applicant: Ford Global Technologies, LLC, Dearborn, MI (US)

(72) Inventors: Livianu Dorin Puscas, Rochester Hills, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 995 days.

(21) Appl. No.: 14/678,410

(22) Filed: Apr. 3, 2015

(65) Prior Publication Data

US 2016/0290015 A1 Oct. 6, 2016

(51) Int. Cl.

| | |
|---|---|
| ***E05B 79/16*** | (2014.01) |
| ***E05B 77/04*** | (2014.01) |
| ***E05B 79/22*** | (2014.01) |
| ***E05B 85/00*** | (2014.01) |

(52) U.S. Cl.

CPC ..... *E05B 79/16* (2013.01); *E05B 77/04* (2013.01); *E05B 79/22* (2013.01); *E05B 85/00* (2013.01)

(58) Field of Classification Search

CPC ..... E05B 77/02; E05B 77/04; E05B 77/06; E05B 79/10; E05B 79/16; E05B 79/20; E05B 79/22; E05B 85/00; E05B 85/10; E05B 85/14; E05B 85/16

See application file for complete search history.

(56) References Cited

U.S. PATENT DOCUMENTS

| | | | |
|---|---|---|---|
| 3,990,531 | A | 11/1976 | Register |
| 4,683,774 | A | 8/1987 | Memmola |
| 5,037,145 | A | 8/1991 | Wilkes |
| 5,123,687 | A | 6/1992 | Pfeiffer et al. |
| 5,669,642 | A | 9/1997 | Kang |
| 5,887,918 | A | 3/1999 | Okada et al. |
| 5,927,895 | A | 7/1999 | Watanabe |
| 6,007,122 | A | 12/1999 | Linder et al. |
| 6,042,159 | A | 3/2000 | Spitzley et al. |
| 6,241,294 | B1 | 6/2001 | Young et al. |
| 6,264,257 | B1 | 7/2001 | Meinke |
| 6,712,409 | B2 | 3/2004 | Monig |
| 6,971,688 | B2 | 12/2005 | Drysdale et al. |
| 7,070,212 | B2 | 7/2006 | Spurr |
| 7,097,212 | B2 | 8/2006 | Willats et al. |
| 7,481,468 | B2 | 1/2009 | Merideth et al. |

(Continued)

FOREIGN PATENT DOCUMENTS

| | | | |
|---|---|---|---|
| DE | 19837662 | A1 | 4/1999 |
| DE | 10002215 | C1 | 10/2001 |

(Continued)

*Primary Examiner* — Alyson M Merlino

(74) *Attorney, Agent, or Firm* — Vichit Chea Price Heneveld LLP

(57) ABSTRACT

A latch system for vehicle doors includes a bypass mechanism that mechanically disconnects a linkage assembly if an exterior door handle is moved towards an open position at a high speed. The bypass mechanism ensures that the door latch mechanism does not unlatch in the event a crash causes the exterior door handle to move open at a high speed, while providing for normal unlatching operation if the exterior door handle is opened at a relatively low velocity by a user.

18 Claims, 5 Drawing Sheets

(56) References Cited

U.S. PATENT DOCUMENTS

| | | | | |
|---|---|---|---|---|
| 7,635,151 | B2 | 12/2009 | Rodawold, Jr. et al. | |
| 7,686,355 | B2 | 3/2010 | Jankowski et al. | |
| 7,810,852 | B2 | 10/2010 | Alacqua et al. | |
| 8,029,032 | B1 | 10/2011 | Yang | |
| 8,152,209 | B2 | 4/2012 | Lee | |
| 8,303,004 | B2 | 11/2012 | Lee et al. | |
| 8,322,077 | B2 | 12/2012 | Papanikolaou et al. | |
| 8,366,159 | B2 | 2/2013 | Patel | |
| 8,616,611 | B2 | 12/2013 | Schidan et al. | |
| 8,701,817 | B2 | 4/2014 | Schoen | |
| 8,814,232 | B2 | 8/2014 | Bertolotti | |
| 8,899,640 | B2 | 12/2014 | Bertolotti Potachin | |
| 9,115,514 | B2 | 8/2015 | Papanikolaou et al. | |
| 9,605,450 | B2 | 3/2017 | Puscas et al. | |
| 2005/0184537 | A1 | 8/2005 | Le et al. | |
| 2007/0120382 | A1* | 5/2007 | Chevalier | E05B 77/06 292/336.3 |
| 2009/0223263 | A1 | 9/2009 | Puscas et al. | |
| 2010/0301618 | A1 | 12/2010 | Costigan et al. | |
| 2010/0320777 | A1 | 12/2010 | Jankowski et al. | |
| 2013/0056999 | A1 | 3/2013 | Beck | |
| 2013/0229022 | A1 | 9/2013 | Lesueur | |
| 2013/0233034 | A1 | 9/2013 | Ono et al. | |
| 2014/0015263 | A1 | 1/2014 | Da Deppo et al. | |
| 2014/0097624 | A1 | 4/2014 | Papanikolaou et al. | |
| 2014/0132008 | A1 | 5/2014 | Bendel et al. | |
| 2014/0145454 | A1 | 5/2014 | Da Deppo et al. | |
| 2014/0367977 | A1 | 12/2014 | Beck et al. | |
| 2015/0159408 | A1 | 6/2015 | Hunt et al. | |
| 2015/0240537 | A1 | 8/2015 | Cumbo | |
| 2015/0337566 | A1* | 11/2015 | Wittelsbuerger | E05B 77/02 292/194 |
| 2015/0345188 | A1 | 12/2015 | Puscas et al. | |
| 2016/0097223 | A1* | 4/2016 | Rosales | E05B 77/06 292/92 |
| 2016/0290015 | A1 | 10/2016 | Puscas et al. | |
| 2017/0159329 | A1 | 6/2017 | Puscas et al. | |
| 2018/0044947 | A1 | 2/2018 | Manolescu et al. | |

FOREIGN PATENT DOCUMENTS

| | | | |
|---|---|---|---|
| DE | 202006011206 | U1 | 11/2007 |
| DE | 102009038612 | A1 | 3/2011 |
| DE | 202010014992 | U1 | 1/2012 |
| DE | 202013103708 | U1 | 11/2014 |
| DE | 102013021521 | A1 | 6/2015 |
| JP | 2011099238 | A | 5/2011 |
| WO | 2013093092 | A1 | 6/2013 |
| WO | 2014188909 | A1 | 11/2014 |

* cited by examiner

VEHICLE DOOR LATCH WITH RELEASE LINKAGE BYPASS DEVICE

FIELD OF THE INVENTION

The present invention generally relates to a door latch system for motor vehicles, and specifically to a door latch that does not release if the exterior door handle is moved open at a high speed.

BACKGROUND OF THE INVENTION

Various types of vehicle door latches and handles have been developed. The latch and handle assembly may include a handle that can be pulled outwardly by a user to release a door latch, thereby permitting the door to open. However, if a vehicle is subject to lateral acceleration due to a side impact such as a crash, the acceleration may cause the handle to shift outwardly due to its own mass, thereby causing the latch to release. Various counterweights and inertia locks have been developed to prevent inadvertent unlatching of a door latch during lateral acceleration of the vehicle.

SUMMARY OF THE INVENTION

One aspect of the present invention is a latch system for vehicle doors including a movable door handle and a door latch mechanism having latched and unlatched configurations. A first linkage is connected to the door handle such that movement of the door handle moves the first linkage. A second linkage is connected to the door latch mechanism such that movement of the second linkage causes the latch mechanism to shift from the latched configuration to the unlatched configuration. The latch system further includes a bypass mechanism having an engaged configuration in which the bypass mechanism interconnects the first and second linkages such that movement of the first linkage causes movement of the second linkage to thereby unlatch the latch mechanism. The bypass mechanism disconnects the first and second linkages when the bypass mechanism is in a bypassed configuration such that movement of the first linkage does not cause movement of the second linkage to unlatch the latch mechanism. The bypass mechanism further defines a home configuration. When the bypass mechanism is in its home configuration, movement of the first linkage at a first velocity relative to the second linkage causes the bypass mechanism to shift from its home configuration to its engaged configuration. When the bypass mechanism is in its home configuration, movement of the first linkage relative to the second linkage at a second velocity that is significantly greater than the first velocity causes the bypass mechanism to shift from its home configuration to its bypass configuration such that movement of the first linkage at the second velocity does not unlatch the latch mechanism. The bypass mechanism includes a locking member that is connected to a selected one of the first and second linkages. The locking member includes a first engagement surface and a retaining surface. The bypass mechanism further includes a lever support that is connected to the other of the first and second linkages. The bypass mechanism still further includes a lever that is movably connected to the lever support. The lever includes a second engagement surface that is configured to engage the first engagement surface, whereby the lever interconnects the lever support and the locking member when the bypass mechanism is in its engaged configuration. The lever engages the retaining surface when the bypass mechanism is in its home configuration to prevent the second engagement surface from engaging the first engagement surface. The lever support is disconnected from the locking member when the bypass mechanism is in its bypassed configuration.

Another aspect of the present invention is a latch system for vehicle doors. The latch system includes a movable door handle, a door latch mechanism, and a bypass mechanism defining an engaged configuration, a bypass configuration, and a home configuration. The latch system further includes a linkage assembly including first and second linkages that are connected to the bypass mechanism to operably interconnect the door handle and the door latch mechanism when the bypass mechanism is in its engaged configuration. The bypass mechanism includes a locking member that is connected to the first linkage. The locking member defines an axis, and includes an end and an outer surface that is spaced from the axis a first distance. The locking member further includes an outer second surface at the end of the locking member that is spaced from the axis a second distance that is less than the first distance. The locking member further includes a recess that is disposed between the outer first and second surfaces. The bypass mechanism further includes a lever that is pivotably connected to the second linkage for rotation about a second axis that is transverse to the first axis. The lever includes a hooked end portion that slidably engages the outer first surface when the bypass mechanism is in its home configuration. If the door handle is moved from a rest position to an actuated position by a user, the hooked end portion rotates into engagement with the recess to interconnect the lever with the locking member such that the first and second linkages are interconnected, and movement of the door handle shifts the first and second linkages and unlatches the door latch mechanism. If the door handle is moved from a rest position to an actuated position at a relatively high velocity due to a vehicle crash, the hooked end of the lever slides on the first outer surface and moves across the recess without engaging the recess, and slidably engages the outer second surface, such that the first and second linkages are disconnected, and the movement of the door handle does not unlatch the door latch mechanism.

Another aspect of the present invention is a vehicle door latch assembly including a door handle that is operably connected to a latch by first and second cables. The first and second cables are releasably interconnected by a spring-biased rotating lever having a hooked end. The hooked end slidably engages an outer surface of a locking member, and then engages a groove of the locking member to interconnect the first and second cables only if the door handle moves at a speed below a predefined speed.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
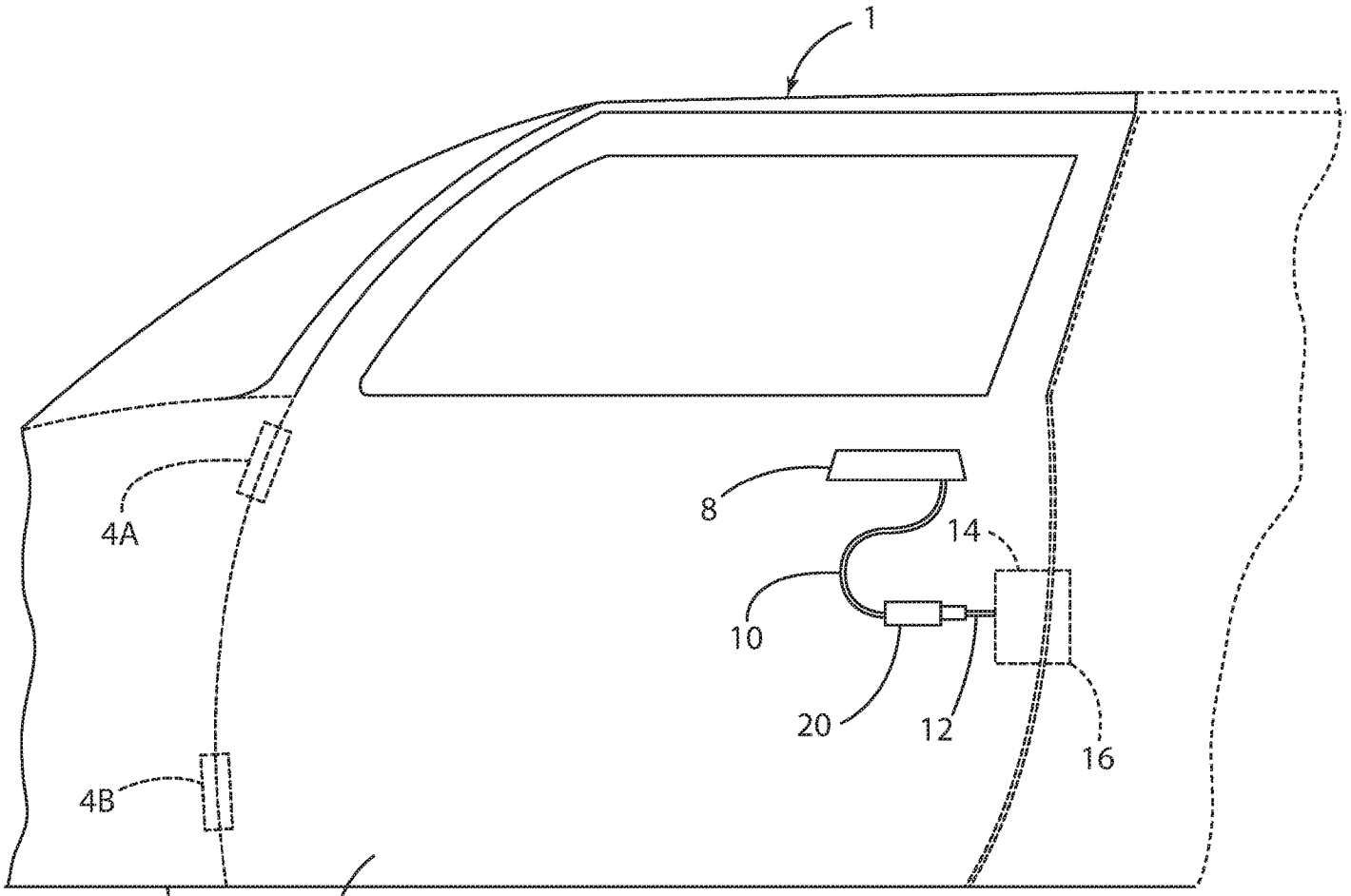
FIG. 1 is a partially fragmentary schematic side elevational view of a vehicle door including a latch system having a bypass device according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a motor vehicle 1 includes one or more doors 2 that are movably mounted to a vehicle structure 6 by one or more hinges 4A, 4B. A movable exterior door handle 8 is connected to a latch mechanism 14 by first and second linkages such as cables 10 and 12 and a bypass mechanism 20 that selectively interconnects cables 10 and 12. Latch mechanism 14 engages a striker 16 when the latch mechanism 14 is in a latched state or configuration to thereby selectively retain the door 2 in a closed position. Latch mechanism 14 and striker 16 may comprise a conventional latch mechanism and striker of a type that is well known in the art. As discussed in more detail below, when exterior door handle 8 is moved outwardly by a user, the bypass mechanism 20 mechanically interconnects the cables 10 and 12 such that movement of the exterior door handle 8 by a user unlatches the latch mechanism 14 so it is no longer latched to striker 16, thereby permitting the door 2 to open (provided the latch mechanism 14 is not in a locked configuration). However, in the event of a vehicle crash/side impact resulting in rapid outward movement of exterior door handle 8, the bypass mechanism 20 will mechanically disconnect first and second cables 12 such that the rapid movement of exterior door handle 8 does not unlatch the latch mechanism 14.

Figure 2:
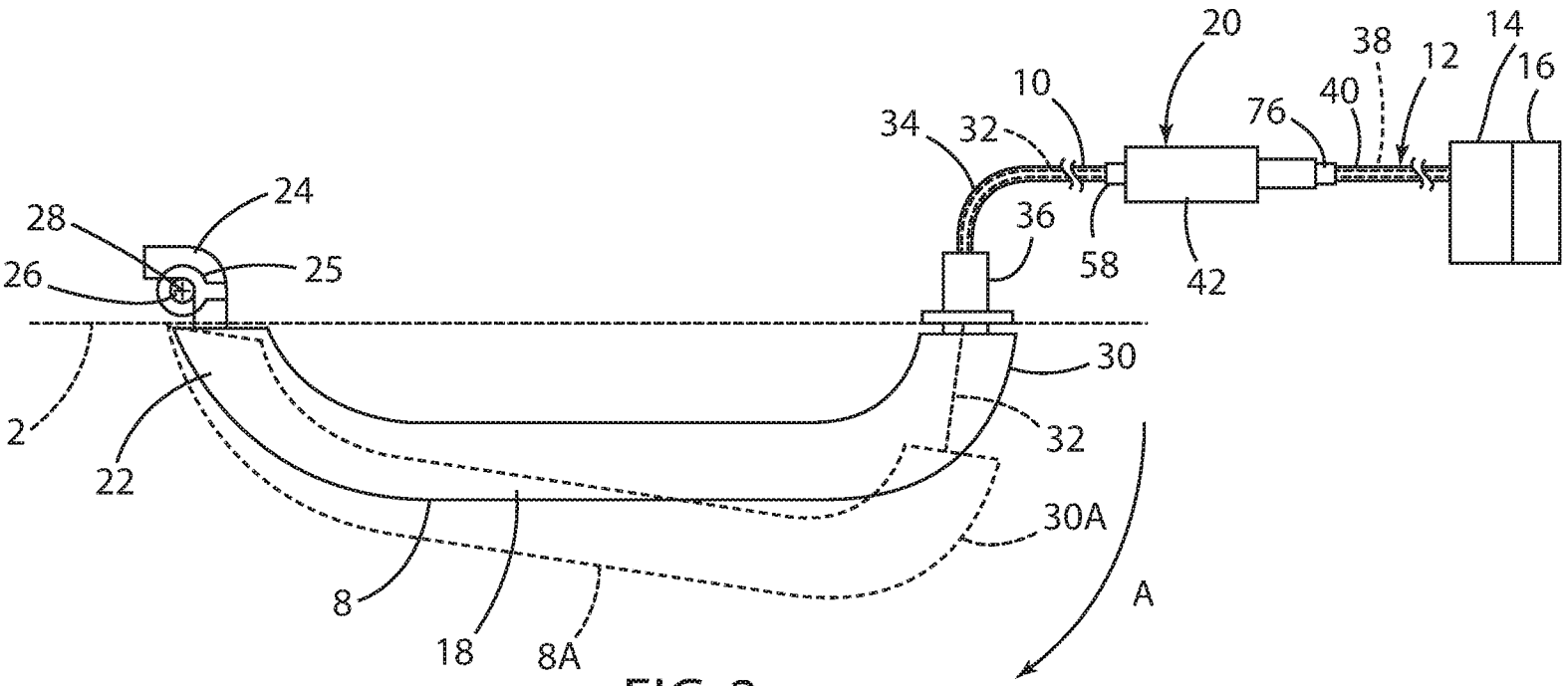
FIG. 2 is a partially fragmentary schematic top plan view of the vehicle door handle and latch system of FIG. 2.

With reference to FIG. 2, handle 8 may comprise a strap type handle of a known design having a body portion 18 defining a forward end 22 having a connecting structure 24 that rotatably engages a hinge pin or pivot 26 whereby the handle 8 rotates outwardly as shown by the arrow "A" about a vertical axis 28 relative to the door 2 to a released position shown in dashed lines 8A. A spring such as torsion spring 25 biases the handle member 8 towards a closed position such that the handle 8 returns to the closed position after the handle 8 is released by a user. A rear end portion 30 of handle 8 is connected to an inner strand 32 of first cable 10, such that outward movement of rear end portion 30 to the released position 30A shifts strand 32 lengthwise. A first end of an outer sheath 34 of cable 10 is connected to a fitting 36 that is secured to the door 2, and an opposite end of outer sheath 34 of cable 10 is connected to housing 42 of bypass mechanism 20 by a fitting 58 of a known type. Cable 12 may comprise an inner strand 38 and an outer sheath 40. A first end of the outer sheath 40 is connected to housing 42 of bypass mechanism 20 utilizing a fitting 76 (FIG. 3) of a known type, and the other end of outer sheath 40 is be connected to latch mechanism 14 utilizing a fitting 36 of a known type. The bypass mechanism 20 may be utilized in connection with a strap type exterior door handle 8 as shown in FIG. 2, or the bypass mechanism 20 may be utilized in connection with other types of moveable exterior door handles that are known in the art.

Figure 3:
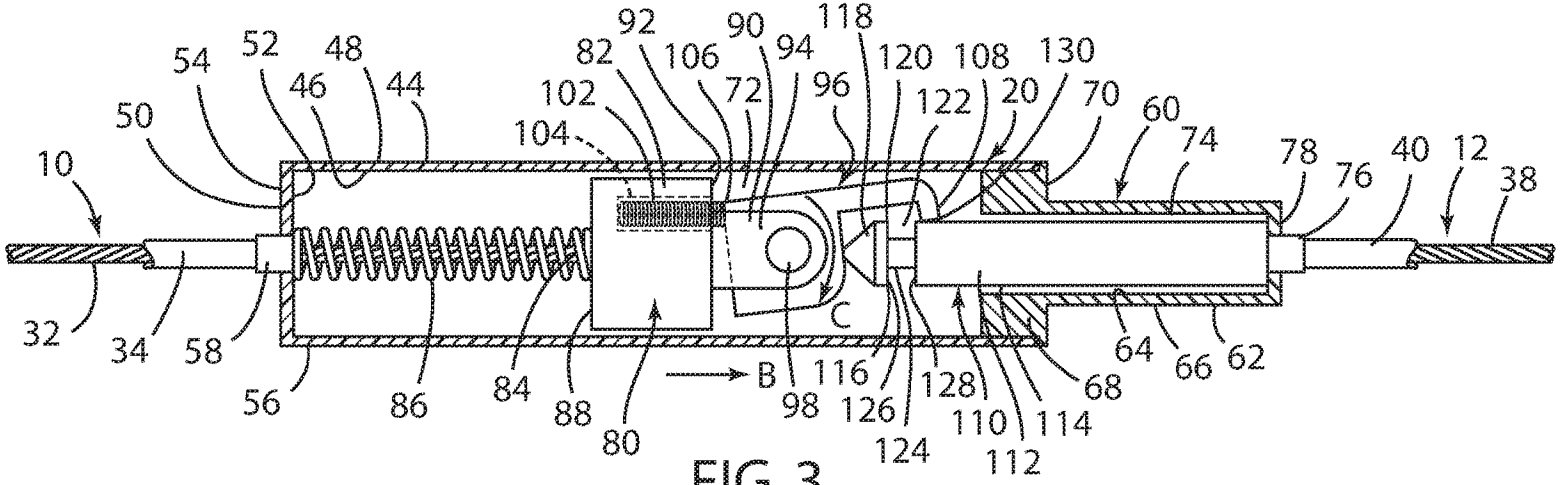
FIG. 3 is a cross sectional view of a bypass mechanism according to the present invention showing the bypass mechanism in a home configuration.

With further reference to FIG. 3, the bypass mechanism 20 includes a main housing 44 having inner and outer cylindrical surfaces 46 and 48, respectively and an end wall 50 having inner and outer surfaces 52 and 54, respectively at a first end 56 of main housing 44. A fitting 58 on end wall 50 connects the outer sheath 34 of cable 10 to the main housing 44. A second or smaller housing 60 includes a first portion 62 having cylindrical inner and outer surfaces 64 and 66, respectively, and an enlarged end portion 68 that is received in an open second end 70 of main housing 44. The smaller housing 60 may be secured to the main housing 44 by welding, adhesives, crimping, or other suitable techniques. The housings 60 and 44 may be made from metal (e.g. steel), polymer, or other suitable material. The main housing 44 defines a generally cylindrical main cavity 72, and the second housing 60 defines a generally cylindrical smaller second cavity portion that joins to the main cavity 72. A fitting 76 is mounted on an end wall 78 of second housing 60. The fitting 76 attaches the outer sheath 40 of second cable 12 to the second housing 60.

The bypass mechanism 20 also includes a lever support member 80 having a cylindrical outer surface 82 that slidably supports the lever support member 80 in the main housing 44 for reciprocating movement of lever support member 80. End 84 of inner cable strand 32 is connected to lever support member 80, such that lever support member 80 moves with inner cable strand 32. A coil spring 86 is disposed around inner cable strand 32 between an end surface 88 of lever support member 80 and inner surface 52 of end wall 50 of main housing 44. Coil spring 86 biases the lever support member 80 in the direction of the arrow "B" when coil spring 86 is compressed. Lever support member 80 includes a pair of extensions 90 that extend from end surface 92 of lever support member 80 to form a clevis 94. A lever member 96 is rotatably connected to lever support member 80 at clevis 94 by a pin 98. A second spring 102 is disposed in a cylindrical cavity 104 of lever support member 80. The second spring 102 is a compression spring that bears against end surface 106 of lever member 96 to thereby bias the lever member 96 in the direction of the arrow "C" about the pin 98. Second spring 102 may, alternatively, comprise a torsion spring (not shown) disposed about the pin 98. As discussed in more detail below, the lever member 96 includes an end portion 108 that contacts a locking barrel member 110 when the bypass mechanism 20 is in the home configuration shown in FIG. 3.

Locking barrel member 110 includes an elongated body portion 112 having a cylindrical first outer surface 114. The locking barrel member 110 is slidably disposed in the second cavity 74 of second housing 60. The locking barrel member 110 is connected to the inner cable strand 38 of second cable 12, such that the locking barrel member 110 and inner cable strand 38 move together. Locking barrel member 110 further includes an end portion 116 having a tapered, conical outer surface 118, and a cylindrical second outer surface 120. An annular groove 122 is disposed between the cylindrical first outer surface 114 and the cylindrical second outer surface 120. Annular groove 122 is defined by a cylindrical surface 124 having a diameter that is significantly less than the diameters of the first and second outer surfaces 114 and 120, and spaced apart side surfaces 126 and 128.

Figure 4:
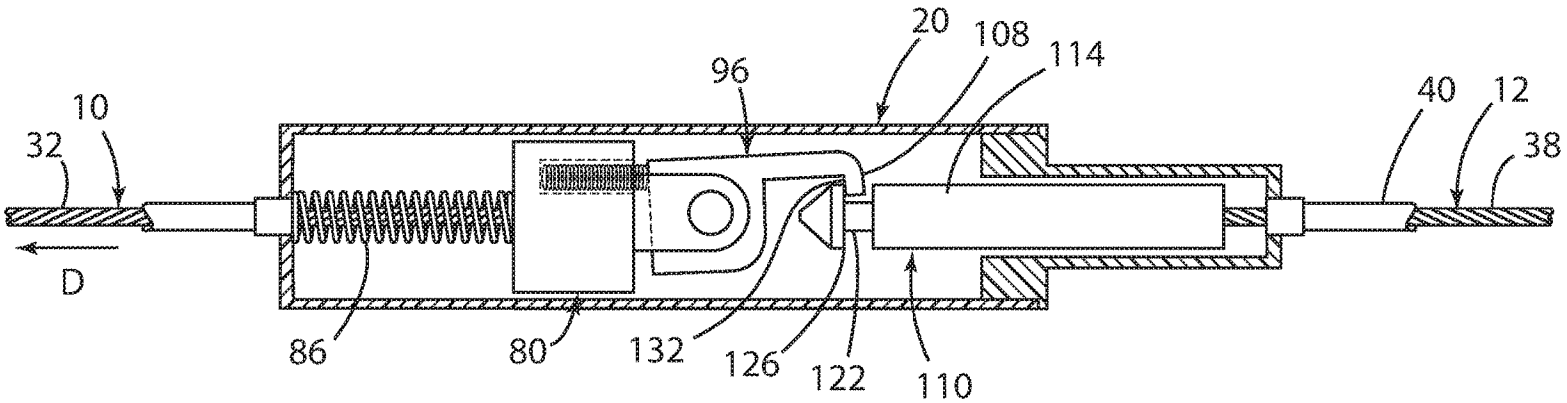
FIG. 4 is a cross sectional view of the bypass mechanism of FIG. 3 showing the bypass mechanism in an engaged configuration.

In use, when exterior door handle 8 is in a closed or non-actuated rest position, the bypass mechanism 20 is in a home position or configuration as shown in FIG. 3. When bypass mechanism 20 is in the home configuration, end surface 130 of end 108 of lever member 96 is in sliding contact with cylindrical first outer surface 114 of locking barrel member 110. The end surface 130 is biased into contact with the cylindrical first outer surface 114 by second spring 102. If a user pulls outwardly on the exterior door handle 8, inner cable strand 32 of first cable 10 will move in the direction of the arrow "D" (FIG. 4). As the lever support member 80 moves in the direction of the arrow D, and the end 108 of lever member 96 will engage annular groove 122 due to the bias of second spring 102. Side surface 132 of end 108 of lever member 96 then comes into contact with side surface 126 of annular groove 122 to thereby mechanically interconnect inner strands 32 and 38 of first and second cables 10 and 12, respectively with respect to tension forces acting on cable strands 32 and 38. Thus, as the exterior door handle 8 is pulled further towards its open position 8A (FIG. 2) movement of inner cable strand 32 causes movement of inner cable strand 38. Movement of inner cable strand 38 causes latch mechanism 14 to unlatch, thereby permitting a user to open the vehicle door 2.

Figure 5:
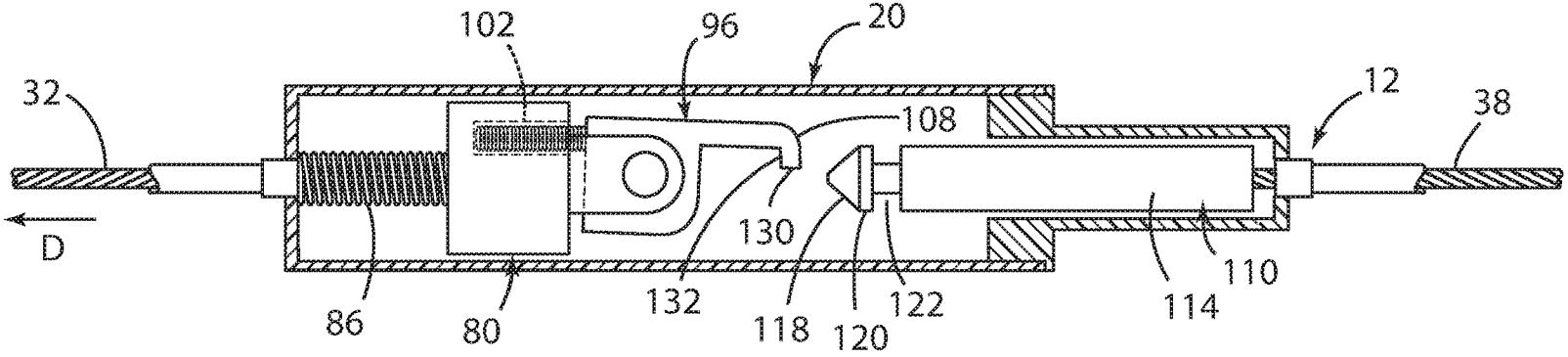
FIG. 5 is a cross sectional view of the bypass mechanism in a released configuration.

However, if the exterior door handle 8 is initially in a rest or non-actuated position, and the bypass mechanism 20 is in its home position or configuration (FIG. 3), and if the exterior door handle 8 is moved outwardly at a high speed/velocity due to a side impact or the like, the bypass mechanism 20 will shift to the bypassed or disengaged configuration of FIG. 5. When bypass mechanism 20 is in the bypassed configuration, cable strand 32 is mechanically disconnected from inner cable strand 38 such that movement of cable strand 32 does not result in movement of inner cable strand 38. Thus, when bypass mechanism 20 is in its bypass configuration, movement of the exterior door handle 8 does not unlatch the latch mechanism 14.

The first cylindrical first outer surface 114 of locking barrel member 110 has a diameter that is somewhat greater than the diameter of cylindrical second outer surface 120. If lever support member 80 is moved in the direction of the arrow D (FIG. 4) at a relatively high speed/velocity, the end surface 130 of end 108 of lever member 96 initially slides on cylindrical first outer surface 114 of locking barrel member 110. However, if lever support member 80 is moving at a relatively high velocity, the end surface 130 "jumps" across the annular groove 122, and then slidably engages the cylindrical second outer surface 120. The end surface 130 of lever member 96 then slides off the tapered outer end surface 118 of locking barrel member 110, thereby shifting the bypass mechanism 20 to the bypassed or disconnected configuration of FIG. 5.

Although the second spring 102 biases the end 108 of lever member 96 towards the annular groove 122, the second spring 102 may be selected to provide a relatively small biasing force such that the rotational inertia of lever member 96 results in a relatively slow rotational acceleration and velocity of lever member 96 as it slides off cylindrical first outer surface 114. The mass/rotational inertia of lever member 96 and bias of second spring 102, along with the dimensions of the cylindrical first outer surface 114, cylindrical second outer surface 120, and annular groove 122 can be selected such that the bypass mechanism 20 shifts to the engaged configuration (FIG. 4) if handle 8 is moving at a relatively slow velocity, but shifts to the bypassed or disconnected configuration (FIG. 5) if the exterior door handle 8 is moved at a relatively high speed/velocity. Specifically, a user will typically move the exterior door handle 8 outwardly at a speed that is less than 500 ms. Accordingly, the components of the bypass mechanism 20 can be selected such that the bypass mechanism 20 shifts from the home configuration (FIG. 3) to the engaged configuration (FIG. 4) if the exterior door handle 8 and cable 32 are moved at a speed of 500 ms or less. However, in the event the exterior door handle 8 moves outwardly at a relatively high velocity due to a side impact, the exterior door handle 8 will normally move at a speed of at least about 2000 ms to 2500 ms. Thus, the bypass mechanism 20 may be configured to shift from the home configuration (FIG. 3) to the disconnected configuration (FIG. 5) if the exterior handle and cable 32 move at a predefined speed that is significantly greater than 500 ms. In a preferred embodiment, the bypass mechanism 20 shifts from the home configuration (FIG. 3) to the engaged configuration (FIG. 4) if the exterior door handle 8 and cable 32 are moving at a speed of 1000 ms or less, and the bypass mechanism 20 shifts from the home configuration (FIG. 3) to the bypass or disconnected configuration (FIG. 5) if the exterior handle 8 and cable 32 are moving at a speed that is greater than 1000 ms. It will be understood that the various components of bypass mechanism 20 may be designed to provide a desired preselected speed at which the bypass mechanism 20 shifts from the home configuration to the disengaged configuration as required for a particular application.

Figure 6:
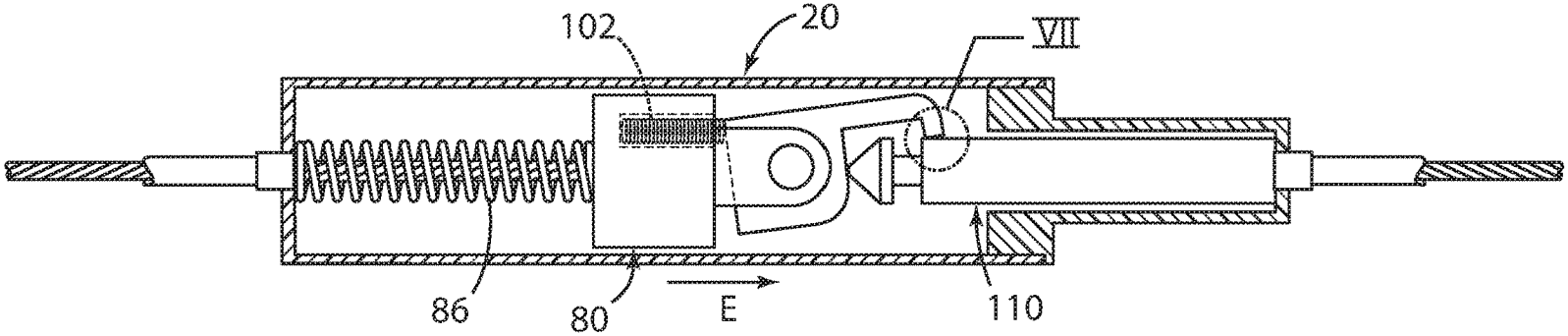
FIG. 6 is a cross sectional view of the bypass mechanism showing the bypass mechanism as it shifts from a disengaged configuration or an engaged configuration to the home configuration of FIGS. 3.

When the bypass mechanism 20 is in the engaged configuration (FIG. 4) or the bypass configuration (FIG. 5), the spring 86 is compressed, thereby generating a force tending to shift the lever support member 80 in the direction of the arrow "E" (FIG. 6) Thus, after the exterior door handle 8 is released by a user, or as the exterior door handle 8 moves inwardly after a side impact due to the bias of spring 25 (FIG. 2), the spring 86 will move the lever support member 80 towards the locking barrel member 110 to reset the bypass mechanism 20.

Figure 7A:
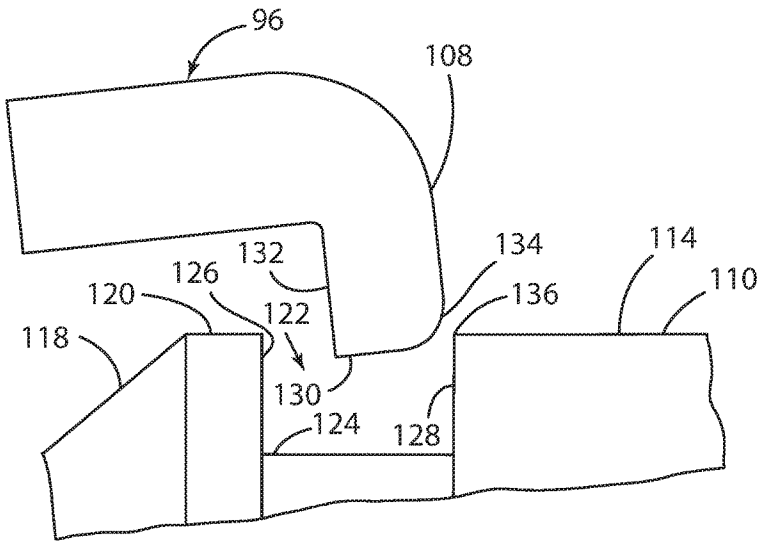
FIG. 7A is a fragmentary enlarged view of a portion of the lever and locking barrel of FIG. 6.

As shown in FIG. 7A, end portion 108 of lever member 96 may include a radiused edge portion 134. The radiused edge portion 134 slidably engages an edge 136 of locking barrel member 110 as the lever support member 80 moves towards the locking barrel member 110. The sliding engagement of the radiused edge 134 on the edge 136 causes the lever member 96 to rotate outwardly away from the annular groove 122 despite the rotational bias of spring 102, and the force of spring 86 returns the bypass mechanism 20 to the home position (FIG. 3) wherein the end surface 130 of lever member 96 engages cylindrical first outer surface 114.

Figure 7B:
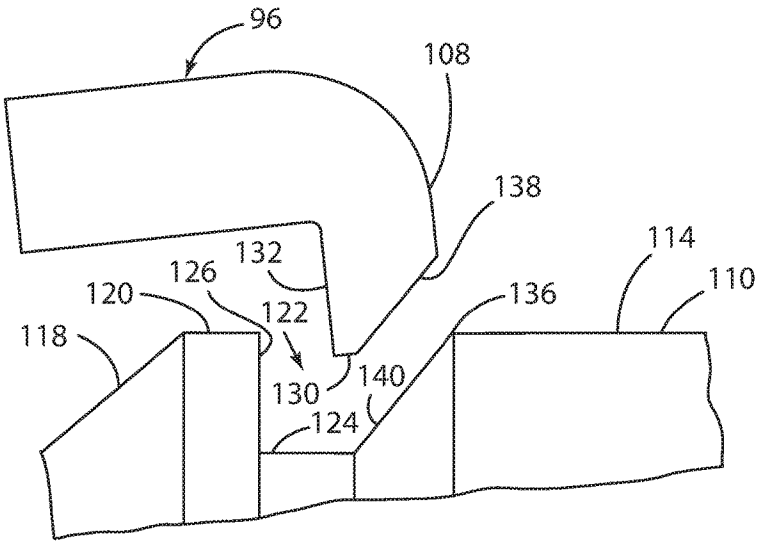
FIG. 7B is a fragmentary enlarged view of a portion of a lever and locking barrel.

Referring to FIG. 7B, end 108 of lever member 96 may, alternatively, include a chamfer 138 instead of radiused edge 134. Annular groove 122 may include a corresponding chamfer or ramp surface 140 rather than a side surface 128. The chamfers 138 and 140 ensure that the lever member 96 shifts to the home position or configuration of FIG. 3 as the lever support member 80 moves towards the locking barrel member 110 due to the bias of spring 86. For example, if the bypass mechanism 28 is in the engaged configuration (FIG. 4), and the exterior door handle 8 is released, the end 108 of lever member 96 will move from the position of FIG. 4 to the home position of FIG. 3 due to the sliding engagement of chamfers 138 and 140.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A latch system for vehicle doors, the latch system comprising:

a movable door handle;

a door latch mechanism having latched and unlatched configurations;

a first linkage connected to the door handle such that movement of the door handle moves the first linkage;

a second linkage connected to the door latch mechanism such that movement of the second linkage causes the latch mechanism to shift from the latched configuration to the unlatched configuration;

a bypass mechanism having an engaged configuration in which the bypass mechanism interconnects the first and second linkages such that movement of the first linkage causes movement of the second linkage to shift the latch mechanism from the latched configuration to the unlatched configuration, and wherein the bypass mechanism disconnects the first and second linkages when the bypass mechanism is in a bypassed configuration such that movement of the first linkage does not cause movement of the second linkage to shift the latch mechanism from the latched configuration to the unlatched configuration, the bypass mechanism further defining a home configuration, and wherein when the bypass mechanism is in its home configuration, movement of the first linkage at a first velocity relative to the second linkage causes the bypass mechanism to shift from its home configuration to its engaged configuration and wherein, when the bypass mechanism is in its home configuration, movement of the first linkage relative to the second linkage at a second velocity that is greater than the first velocity causes the bypass mechanism to shift from its home configuration to its bypassed configuration such that the movement of the first linkage at the second velocity does not shift the latch mechanism from the latched configuration to the unlatched configuration, the bypass mechanism including:

a locking member connected to a selected one of the first and second linkages, the locking member including a first engagement surface and a retaining surface;

a lever support connected to the other of the first and second linkages;

a rigid lever pivotably connected to the lever support, the lever including a second engagement surface configured to engage the first engagement surface, whereby the lever interconnects the lever support and the locking member when the bypass mechanism is in its engaged configuration, and wherein the lever engages the retaining surface to prevent the second engagement surface from engaging the first engagement surface when the bypass mechanism is in its disengaged configuration, and wherein the lever support is disconnected from the locking member when the bypass mechanism is in its bypassed configuration.

2. The latch system of claim 1, wherein:

the locking member includes a recess, and wherein the first engagement surface comprises a side surface of the recess.

3. The latch system of claim 2, wherein:

the recess is in the form of an annular groove.

4. The latch system of claim 3, wherein:

the locking member includes a cylindrical first outer surface, adjacent the annular groove, which forms the retaining surface.

5. The latch system of claim 4, wherein:

the locking member defines an end portion that includes a cylindrical second outer surface, and wherein the annular groove is disposed between the cylindrical first and second outer surfaces.

6. The latch system of claim 5, wherein:

the cylindrical second outer surface has a diameter less than a diameter of the cylindrical first outer surface.

7. The latch system of claim 6, wherein:

the lever includes a base portion that is pivotably connected to the lever support.

8. The latch system of claim 7, wherein:

the lever includes a central portion extending from the base portion, and a transversely extending portion that forms the second engagement surface.

9. The latch system of claim 8, wherein:

the transversely-extending portion forms a hooked tip that is received in the annular groove when the lever is in an engaged position, in which the lever engages the first engagement surface.

10. The latch system of claim 1, wherein:

the first and second linkages comprise elongated flexible cables.

11. A latch system for vehicle doors, the latch system comprising:

a movable door handle;

a door latch mechanism;

a bypass mechanism defining an engaged configuration, a bypassed configuration, and a home configuration;

a linkage assembly including first and second linkages connected to the bypass mechanism and operably interconnecting the door handle and the door latch mechanism when the bypass mechanism is in its engaged configuration;

the bypass mechanism including a locking member connected to the first linkage, the locking member defining a first axis and including an end and a cylindrical outer first surface that is spaced from the first axis at a first distance comprising a first radius, the locking member further including an outer second surface at the end of the locking member that is spaced from the first axis at a second distance that is less than the first distance, the locking member further including a recess between the outer first and second surfaces, and wherein the bypass mechanism further includes a lever pivotably connected to the second linkage for rotation about a second axis that is transverse to the first axis, and wherein the lever includes a hooked end portion that slidably engages the cylindrical outer first surface when the bypass mechanism is in its home configuration;

and wherein, when the bypass mechanism is in its home configuration and the door handle is moved from a rest position to an actuated position by a user, the hooked end portion rotates into engagement with the recess to interconnect the lever with the locking member such that the bypass mechanism is in its engaged configuration in which the first and second linkages are interconnected and the movement of the door handle shifts the first and second linkages and unlatches the door latch mechanism;

and wherein, when the bypass mechanism is in its home configuration and the door handle is moved from the rest position to the actuated position at a high velocity due to a vehicle crash, the hooked end portion of the lever slides on the cylindrical outer first surface and moves across the recess without engaging the recess, and slidably engages the outer second surface, such that the bypass mechanism is in its bypassed configuration in which the first and second linkages are disconnected, and the movement of the door handle does not unlatch the door latch mechanism.

12. The latch system of claim 11, wherein:

the outer second surface is cylindrical, and the second distance comprises a second radius.

13. The latch system of claim 12, wherein:

the recess is in the form of an annular groove disposed between the cylindrical outer first and second surfaces.

14. The latch system of claim 13, wherein:

the hooked end portion defines a tip that engages the outer first surface of the locking member when the bypass mechanism is in its home configuration.

15. The latch system of claim 14, including:

a torsion spring rotatably biasing the lever into engagement with the locking member when the bypass mechanism is in its home configuration and when the bypass mechanism is in its engaged configuration.

16. The latch system of claim 15, wherein:

the locking member includes a tapered tip portion adjacent the cylindrical outer second surface whereby the tip of the hooked end portion of the lever slidably engages the tapered tip portion as the first and second linkages move towards one another as the bypass mechanism is shifted from its bypassed configuration to its home configuration, to thereby rotate the lever against the bias of the torsion spring.

17. A vehicle door latch assembly comprising:

a door handle connected to a latch by first and second cables that are releasably interconnected by a spring-biased, rotating rigid lever having a hooked end that slidably engages a cylindrical outer surface of a cylindrical locking member and then engages a groove of the locking member to interconnect the first and second cables only when the door handle moves at a speed below a predefined speed, and wherein the cylindrical outer surface of the locking member includes cylindrical first and second surface portions disposed on opposite sides of the groove, and wherein the hooked end slidably engages the cylindrical second outer surface portion when the door handle is in a closed position.

18. The vehicle door latch assembly of claim 17, wherein:

the cylindrical second outer surface portion has a diameter that is less than a diameter of the cylindrical first outer surface portion;

the groove is in the form of an annular groove disposed between the cylindrical first and second outer surfaces portions.

* * * * *